US011450981B2

(12) United States Patent
Kwon et al.

(10) Patent No.: US 11,450,981 B2
(45) Date of Patent: Sep. 20, 2022

(54) TERMINAL FASTENING STRUCTURE OF CONNECTOR FOR ELECTRIC VEHICLE

(71) Applicants: Hyundai Motor Company, Seoul (KR); Kia Motors Corporation, Seoul (KR); Korea Electric Terminal Co., Ltd., Incheon (KR); Hyundai Mobis Co., Ltd., Seoul (KR)

(72) Inventors: Beomjoo Kwon, Gyeonggi-do (KR); HuiTae Yang, Gyeonggi-do (KR); Sugil Kang, Incheon (KR); Tae Hong Kim, Gyeonggi-do (KR); Hun Hee Oh, Incheon (KR)

(73) Assignees: Hyundai Motor Company, Seoul (KR); Kia Motors Corporation, Seoul (KR); Korea Electric Terminal Co., Ltd., Incheon (KR); Hyundai Mobis Co., Ltd., Seoul (KR)

( * ) Notice: Subject to any disclaimer, the term of this patent is extended or adjusted under 35 U.S.C. 154(b) by 8 days.

(21) Appl. No.: 17/106,637

(22) Filed: Nov. 30, 2020

(65) Prior Publication Data

US 2021/0399458 A1 Dec. 23, 2021

(30) Foreign Application Priority Data

Jun. 23, 2020 (KR) ..... 10-2020-0076365

(51) Int. Cl.
*H01R 13/426* (2006.01)
*H01R 13/502* (2006.01)
*H01R 13/6581* (2011.01)

(52) U.S. Cl.
CPC ..... *H01R 13/426* (2013.01); *H01R 13/502* (2013.01); *H01R 13/6581* (2013.01); *H01R 2201/26* (2013.01)

(58) Field of Classification Search
CPC ..... H01R 13/426; H01R 13/502; H01R 13/6581; H01R 2201/26
USPC ..... 439/607.55
See application file for complete search history.

(56) References Cited

U.S. PATENT DOCUMENTS

| | | | | |
|---|---|---|---|---|
| 7,601,019 | B2 * | 10/2009 | Hsieh | H01R 13/426 439/345 |
| 8,992,258 | B2 * | 3/2015 | Raschilla | H01R 13/187 439/607.55 |
| 2019/0157792 | A1 | 5/2019 | Miyamura et al. | |
| 2019/0305461 | A1 | 10/2019 | Miyamura et al. | |

FOREIGN PATENT DOCUMENTS

| | | | | |
|---|---|---|---|---|
| CN | 209266699 | U * | 8/2019 | |
| CN | 110323618 | A * | 10/2019 | H01R 13/42 |
| CN | 209641962 | U * | 11/2019 | |
| CN | 209823007 | U * | 12/2019 | |
| CN | 210137046 | U * | 3/2020 | |
| CN | 210628663 | U * | 5/2020 | |
| CN | 213636524 | U * | 7/2021 | |
| JP | 5291393 | B2 | 9/2013 | |

* cited by examiner

*Primary Examiner* — Peter G Leigh
(74) *Attorney, Agent, or Firm* — Fox Rothschild LLP

(57) ABSTRACT

A terminal fastening structure of a connector for an electric vehicle includes a pair of tab terminals electrically connected to an electrical wire connector, a plug inner housing having an opening at a first end into which the tab terminals are inserted, and a pair of terminal holders fastened to the plug inner housing and fixing the tab terminals to the plug inner housing.

18 Claims, 10 Drawing Sheets

TERMINAL FASTENING STRUCTURE OF CONNECTOR FOR ELECTRIC VEHICLE

CROSS-REFERENCE TO RELATED APPLICATION

This application claims under 35 U.S.C. § 119 the benefit of Korean Patent Application No. 10-2020-0076365 filed in the Korean Intellectual Property Office on Jun. 23, 2020, the entire contents of which are incorporated herein by reference.

BACKGROUND

(a) Technical Field

The present disclosure relates to a terminal fastening structure of a connector, more particularly, to the terminal fastening structure for a high voltage connector for an electric vehicle that improves terminal fixing power and implements a terminal position guarantee structure.

(b) Description of the Related Art

Generally, in a connector (electrical connection system), a retainer for ensuring the connection position is in the form of a slot and a tab, and guides the female/male connector to be fastened in parallel. In addition, fastened connectors are designed to ensure an electrical connection state by preventing them from coming off each other after fastening.

The connection guarantee structure of these connectors is classified as a Connector Position Assurance (CPA) system that guarantees the connection between male and female connectors, and a Terminal Position Assurance (TPA) system that guarantees the connection between the connector and the terminal.

Because a straight type connector has a simple structure, it is not difficult to implement the TPA structure when connecting the connector to the terminal. However, in the case of an angled type connector, it is generally difficult to utilize a position assurance structure. Therefore, in the case of an angled type connector, a TPA structure is not employed or a structure having a weak fastening force is applied.

In addition, in the case of the conventional angled type connector fastening structure, by applying a rear holder type retainer that is inserted from a back of the connector, the retainer holds a position of a terminal when a cable with the terminal crimped is fixed to a connector housing and the cable is shaken or pulled. However, a terminal holding force is somewhat weak. In addition, when TPA is inserted to a side of the housing to ensure the position of the terminal, there is a problem that it cannot be applied to a waterproof connector because a hole is formed on the side of the housing.

The above information disclosed in this Background section is only for enhancement of understanding of the background of the disclosure, and therefore it may contain information that does not form the prior art that is already known in this country to a person of ordinary skill in the art.

SUMMARY

The present disclosure provides a terminal fastening structure of a connector in which a terminal holder is pre-fastened to an inside of a connector housing when assembling the connector, and when a terminal is assembled, a locking protrusion of the terminal and the terminal holder are fastened to realize a terminal position guarantee structure.

A terminal fastening structure of a connector according to an exemplary embodiment of the present disclosure includes a pair of tab terminals electrically connected to an electrical wire connector, a plug inner housing having an opening at one end into which the tab terminal is inserted, and a pair of terminal holders fastened to the plug inner housing and fixing the tab terminal to the plug inner housing.

The terminal fastening structure of the connector according to an exemplary embodiment of the present disclosure may further include a plug outer housing having an opening at a first end into which the plug inner housing is inserted, a plug front shield shell inserted into an opening formed below a second end of the plug outer housing, a plug rear shield shell inserted into the plug outer housing with the plug inner housing inserted therein and electrically connected to the plug front shield shell, and a lever rotatably coupled to an outer surface of the plug outer housing so that the plug outer housing surrounds the plug inner housing, the plug front shield shell, and the plug rear shield shell, i.e., to secure the coupling.

The plug inner housing may have an angled type in which a second end facing the opening into which the tab terminal is inserted is closed and an additional opening is formed below the second end.

The plug inner housing may be inserted into and fixed to an inner side of the plug rear shield shell, and fixing grooves that are coupled to fixing protrusions provided on an inner surface of the plug rear shield shell may be formed on upper and side surfaces of the outer plug inner housing.

The plug inner housing may be formed in a shape whose width is narrowed along a direction in which the tab terminal is inserted, corresponding to the shape of the plug rear shield shell.

The tab terminal may be formed in a plate shape whose width is narrowed along a direction inserted into the plug inner housing.

An edge of each of the tab terminals may be formed in a chamfer shape.

Each of the terminal holders may include a terminal holder surface, a first hook formed on a first side of the terminal holder surface and fastened and fixed to an inside of an inner hole of the plug, and a second hook formed on a second side facing the first side of the terminal holder surface, and pressed by elasticity when the tab terminals are inserted and fixed in the plug inner housing and then restored, and allowing the tab terminals to be fastened and released between the plug inner housing and the terminal holders.

The terminal holder surface may be formed with a thickness of a surface of a side of the second hook greater than that of a surface of a side of the first hook.

A vertical gap preventing protrusion protruding in a direction perpendicular to the terminal holder surface may be provided at a central portion of each of the terminal holders.

The vertical gap preventing protrusions may face each other and be provided as a pair in a staggered form.

A horizontal gap preventing protrusion protruding in a direction parallel to the terminal holder surface may be provided at a central portion of each of the terminal holders.

The plug outer housing may be formed in an angled type in which the second end facing the opening into which the plug inner housing is inserted is closed, and an additional opening is formed below the second end.

The plug outer housing may have a circular columnar rotation protrusion protruding to the outer surface so that the lever is rotatably coupled.

The plug outer housing may have a coupling locking protrusion on an upper surface thereof to engage and fix the lever after being rotated.

The plug front shield shell may include a first lance coupled to an outer surface of the plug inner housing to prevent separation from the plug inner housing, and a second lance coupled to an inner surface of the plug outer housing to prevent separation from the plug outer housing.

An upper edge of the plug front shield shell may be formed in a bent and cut chamfer shape.

In the front shield shell, an inner grounding portion protruding to the inside of the front shield shell to contact the plug rear shield shell for grounding, and an outer grounding portion protruding to the outside of the plug front shield shell for grounding may be provided.

In the rear shield shell, an outer housing fixing protrusion protruding outwardly and fastened to an inner side of the plug outer housing, and an inner housing fixing protrusion protruding inwardly and fastened and fixed to the outside of the plug inner housing may be provided.

The plug rear shield shell may include a contact provided on a surface of the plug rear shield shell and electrically connected to the plug front shield shell.

According to a terminal fastening structure of a connector according to an exemplary embodiment of the present disclosure, by supporting the terminal position guarantee structure so that the terminal is not separated from the connector, there is an effect of reinforcing the terminal holding force and improving the contact reliability of the terminal.

DETAILED DESCRIPTION OF THE EMBODIMENTS

Figure 1:
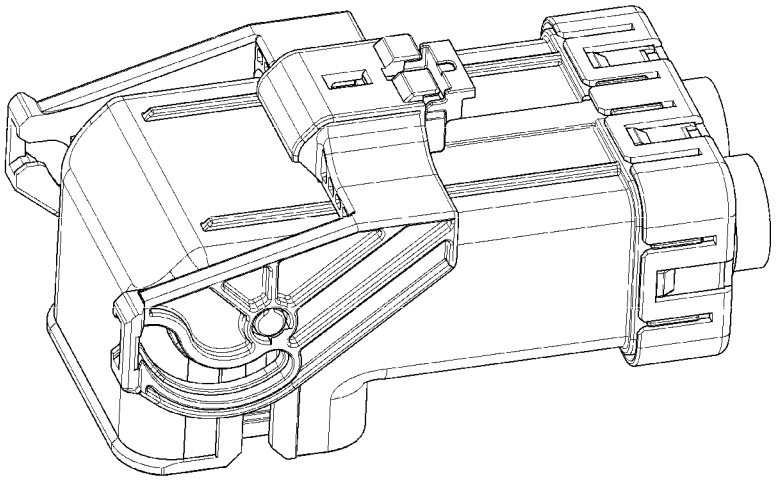
FIG. 1 is a perspective view schematically showing a terminal fastening structure of a connector according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

Further, in exemplary embodiments, since like reference numerals designate like elements having the same configuration, a first exemplary embodiment is representatively described, and in other exemplary embodiments, only configurations different from the first exemplary embodiment will be described.

The drawings are schematic, and are not illustrated in accordance with a scale. Relative dimensions and ratios of portions in the drawings are illustrated to be exaggerated or reduced in size for clarity and convenience, and the dimensions are just exemplified and are not limiting. In addition, like structures, elements, or components illustrated in two or more drawings use same reference numerals for showing similar features. It will be understood that when an element such as a layer, film, region, or substrate is referred to as being "on" another element, it can be directly on the other element or intervening elements may also be present.

The exemplary embodiment of the present disclosure shows an exemplary embodiment of the present disclosure in detail. As a result, various modifications of the drawings will be expected. Therefore, the exemplary embodiment is not limited to a specific aspect of the illustrated region, and for example, includes modifications of an aspect by manufacturing.

Now, a terminal fastening structure of a connector according to an exemplary embodiment of the present disclosure will be described with reference to FIG. 1 to FIG. 10.

Figure 2:
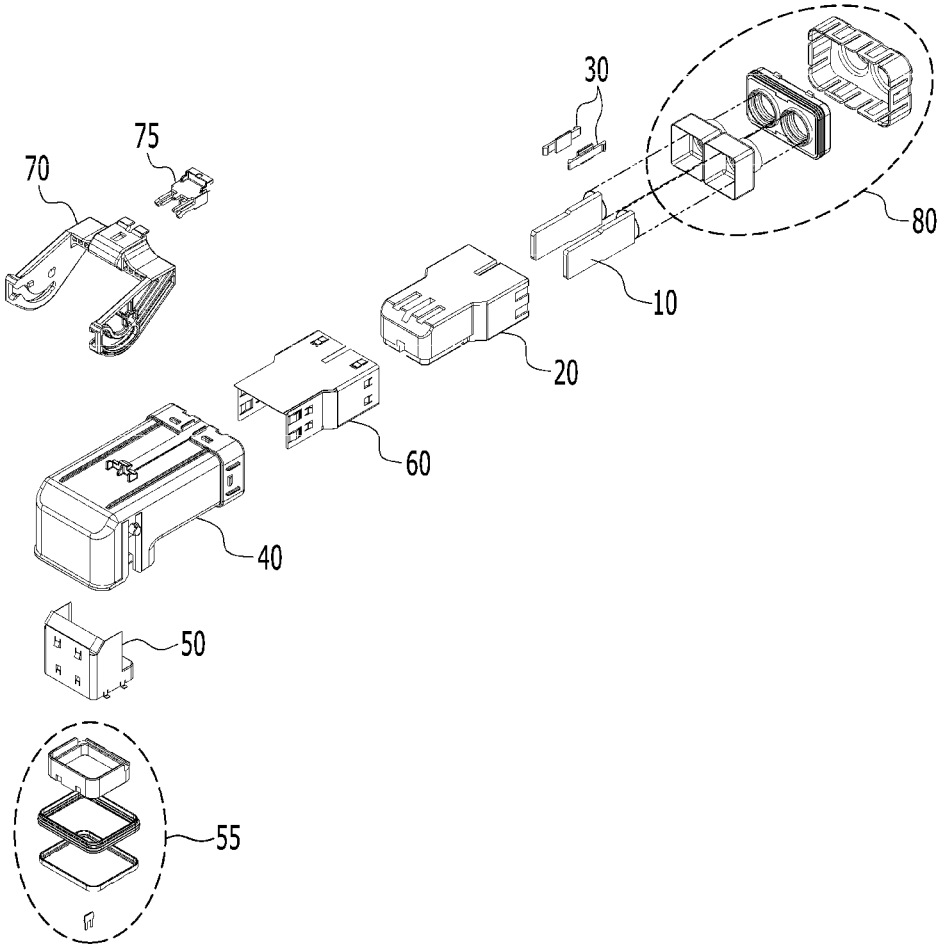
FIG. 2 is an exploded perspective view schematically showing a terminal fastening structure of a connector according to an exemplary embodiment of the present disclosure.

FIG. 1 is a perspective view schematically showing a terminal fastening structure of a connector according to an exemplary embodiment of the present disclosure, and FIG. 2 is an exploded perspective view schematically showing a terminal fastening structure of a connector according to an exemplary embodiment of the present disclosure.

Referring to FIG. 1 and FIG. 2, the terminal fastening structure of a connector according to an exemplary embodiment of the present disclosure includes a tab terminal 10 electrically connected to an electric wire connector, a plug inner housing 20, and a terminal holder 30.

The tab terminals 10 may be provided in a pair to face each other, and an end of the electric wire connector and one end of the tab terminal 10 are coupled and fixed to be electrically connected to the electric wire connector. The tab terminal 10 may be formed of a copper alloy.

The plug inner housing 20 has an opening formed at a first end, and the tab terminal 10 is inserted through the opening. A second end facing the opening of the plug inner housing 20 is closed, and another (or "additional") opening is formed toward the bottom of the second end.

The terminal holder 30 is a component that fixes the tab terminal 10 to the plug inner housing 20 and is fixedly installed in the plug inner housing 20 in advance. The tab terminal 10 may be inserted through the opening of the plug inner housing 20 to be mounted and fixed to the plug inner housing 20 by the terminal holder 30. The terminal holders 30 may be provided as a pair in a shape facing each other so as to correspond to the tab terminals 10 provided in a pair in a shape facing each other.

Referring to FIG. 2, the terminal fastening structure of the connector according to an exemplary embodiment of the present disclosure may further include a plug outer housing 40, a plug front shield shell 50, a plug rear shield shell 60, and a lever 70.

The plug outer housing 40 has an opening formed at one end, and the plug inner housing 20 is inserted through the opening. In addition, the plug inner housing 20 and the plug rear shield shell 60 are inserted into the plug outer housing 40 while the plug inner housing 20 is inserted into the plug rear shield shell 60.

The second end facing the opening of the first end of the plug outer housing 40 is closed, and another opening is formed toward the bottom of the second end. The plug front shield shell 50 is inserted through the opening formed downward of the second end of the plug outer housing 40.

The plug front shield shell 50 and the plug rear shield shell 60 are electrically connected, and may be formed of a copper alloy.

The lever 70 is rotatably coupled to the outer surface of the plug outer housing 40. The plug inner housing 20, the plug front shield shell 50, and the plug rear shield shell 60 are inserted through both openings of the plug outer housing 40. Then, the lever 70 is rotated so as to contact the upper surface of the plug outer housing 40 so that the plug inner housing 20, the plug front shield shell 50, and the plug rear shield shell 60 are firmly attached to the plug outer housing 40.

Meanwhile, the electric wire connector may be stably fixed to the tab terminal 10 by components such as a wire seal, a wire holder, and a plug rear housing, from the left side of the reference numeral 80 shown in FIG. 2. That is, the electrical wire connector may be inserted from the right side of FIG. 2 through the opening of the rear housing of the plug, and may be stably fixed by the wire holder and the wire seal. The wire seal may be formed of silicone to insulate the side of the electrical wire connector from other components. In addition, a locking device 75 may be provided at an end of the lever 70 to lock the lever 70 and the plug rear housing together when the lever 70 contacts the plug outer housing 40.

Meanwhile, at an edge of the opening formed toward the bottom of the second end of the plug outer housing 40, components such as a plug insulation cap, a plug inner seal, a plug seal cap, and a joint terminal of reference numeral '55' shown in FIG. 2 may be fastened. The joint terminal may be formed of a copper alloy, and may be electrically connected to the plug front shield shell 50. The plug inner seal may be formed of silicone to prevent leakage of electricity flowing between the plug front shield shell and the joint terminal to the outside.

Figure 3:
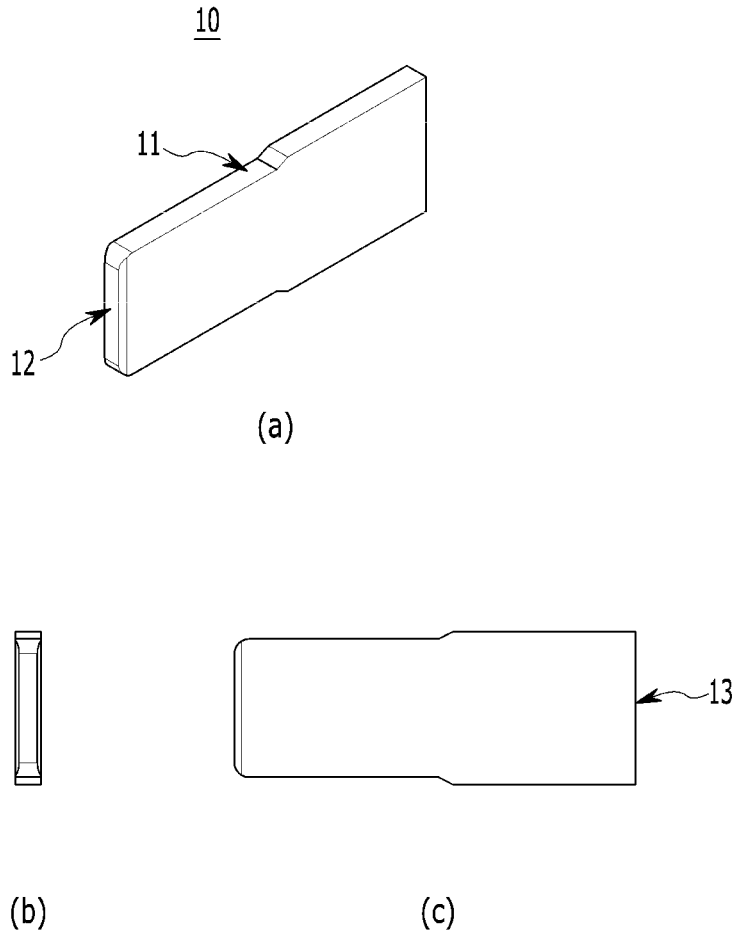
FIG. 3 is a diagram illustrating a tab terminal according to an exemplary embodiment of the present disclosure.

FIG. 3 is a diagram illustrating a tab terminal according to an exemplary embodiment of the present disclosure.

Referring to FIG. 3, a perspective view (a), a front view (b), and a side view (c) of the tab terminal 10 are shown. The tab terminal 10 may be formed in a plate shape whose width is narrowed along a direction inserted into the plug inner housing 20. That is, when the tab terminal 10 is inserted into the plug inner housing 20, the width thereof is formed to be narrowed along the insertion direction so that the tab terminal 10 can be naturally mounted. In addition, an edge of the tab terminal 10 is formed in a chamfer shape, such as the shapes of reference numerals '11' and '12', so that the tab terminal 10 can be naturally inserted into the plug inner housing 20. In addition, the chamfer shape of an edge of the end 12 of the tab terminal 10 is inserted into the plug inner housing 20 and then contacts a front inner side of the plug inner housing 20 to serve as a stopper. Meanwhile, an edge of the other end of the tab terminal 10 of reference numeral '13' may also be formed in a chamfer shape. Therefore, when the tab terminal 10 is fastened to the terminal holder 30, it is possible to induce the tab terminal 10 to ride over without being caught on the edge.

Figure 4:
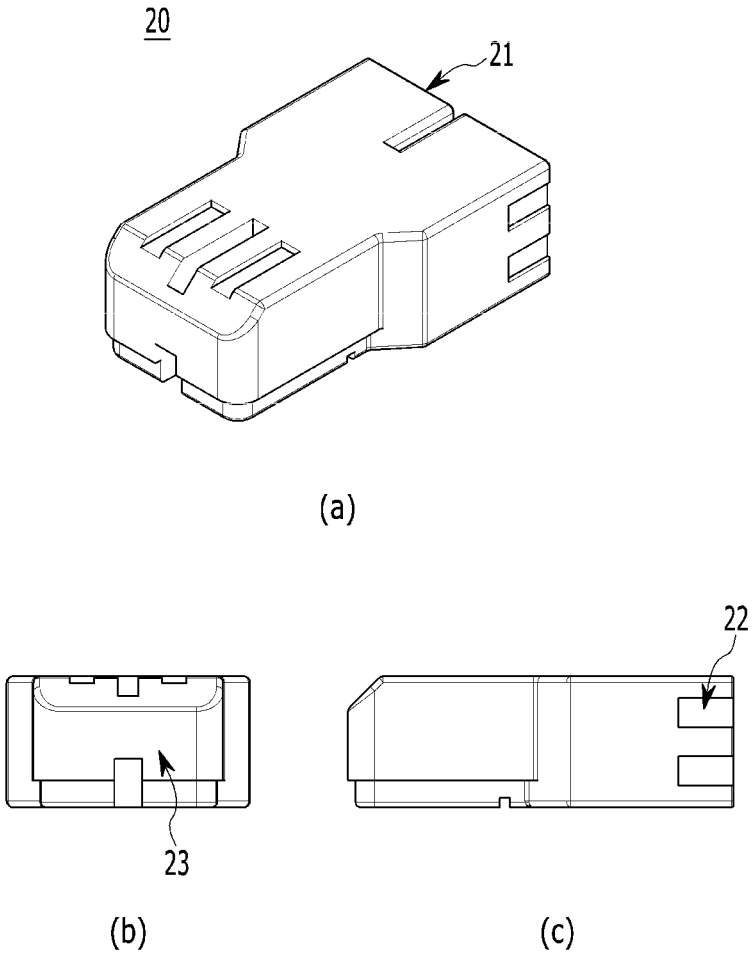
FIG. 4 is a view showing a plug inner housing according to an exemplary embodiment of the present disclosure.

FIG. 4 is a view showing a plug inner housing according to an exemplary embodiment of the present disclosure.

Referring to FIG. 4, a perspective view (a), a front view (b), and a side view (c) of the plug inner housing 20 are shown. In the plug inner housing 20, an opening into which the tab terminal 10 is inserted is formed at a first end, a second end facing the opening into which the tab terminal 10 is inserted is closed, and an angled opening is formed below second other end.

The plug inner housing 20 may be inserted and fixed inside the plug rear shield shell 60, and fixing grooves 21 and 22 are formed on the inner surface of the upper surface and the outer surface of the side surface of the plug inner housing 20, respectively. The fixing grooves 21 and 22 may be coupled with fixing protrusions 62 and 63 provided on the inner surface of the plug rear shield shell 60. The fixing groove 22 is coupled to the fixing protrusion 62 of the plug rear shield shell 60 to each other, and the fixing groove 21 provided on the inner surface of the upper surface of the plug inner housing 20 is fastened to the fixing protrusion 63 of the plug rear shield shell 60. Accordingly, the plug inner housing 20 and the plug rear shield shell 60 can be fixed. The fixing groove 21 may be formed in a shape corresponding to the shape of the fixing protrusion 63 so that the fixing protrusion 63 performs an elastic restoration function of a lance. In addition, a fixing groove may be formed on the front outer surface 23 of the plug inner housing in a shape corresponding to the shape of a first lance 51 so as to be coupled with the first lance 51 of the plug front shield shell 50.

Figure 5:
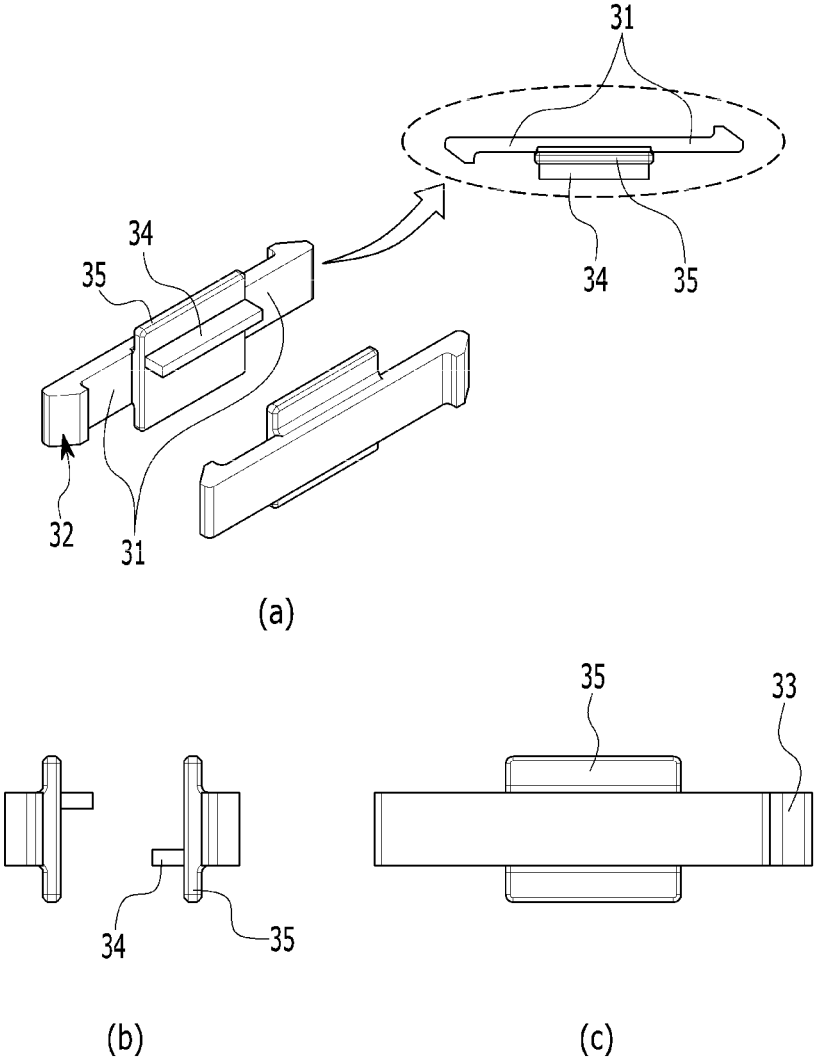
FIG. 5 is a view showing a terminal holder according to an exemplary embodiment of the present disclosure.

FIG. 5 is a view showing a terminal holder according to an exemplary embodiment of the present disclosure. Referring to FIG. 5, a perspective view (a), a front view (b), and a side view (c) of the terminal holder 30 are shown.

The terminal holder 30 includes a terminal holder surface 31, a first hook 32, and a second hook 33. A first hook 32 is formed on a first side of the terminal holder surface 31, and the first hook 32 is fastened and fixed to an inside of a plug inner housing 20. In addition, a second hook 33 is formed on a second side facing the first side of the terminal holder surface 31. The second hook 33 is pressed together with the terminal holder surface 31 on the second hook 33 side by elasticity and then restored. Then, the tab terminal 10 slides in through the second hook 33 and may be fastened and released between the plug inner housing 20 and the terminal holder 30. The first hook 32 and the second hook 33 are formed in a shape of a hook in cross-section to fix the terminal holder 30 so as not to be separated from the plug inner housing 20 after fastening.

The first hook 32 of the terminal holder 30 is fixed in advance to the plug inner housing 20, and the second hook 33 is elastic when the tab terminal 10 is inserted into the plug inner housing 20. The tab terminal 10 can be fastened to the plug inner housing 20 by being pressed and then restored. The terminal holder surface 31 may be formed to have a greater thickness of the surface of the second hook 33 side than the thickness of the surface of the first hook 32 side.

Meanwhile, a vertical gap preventing protrusion 34 protruding in a direction perpendicular to the terminal holder surface 31 may be provided at a central portion of the terminal holder 30. The vertical gap preventing protrusion 34 prevents gap in the vertical direction while the terminal holder 30 is fastened to the inside of the plug inner housing 20. These vertical gap prevention protrusions 34 may be provided as a pair in a cross-sectional shape facing each other.

In addition, a horizontal gap preventing protrusion 35 protruding in a direction parallel to the terminal holder surface 31 may be provided at the central portion of the terminal holder 30. The horizontal gap preventing protrusion 35 prevents a gap in the left and right directions while the terminal holder 30 is fastened to the inside of the plug inner housing 20.

The vertical gap preventing protrusion 34 and the horizontal gap preventing protrusion 35 may be integrally formed, and the vertical gap preventing protrusion 34 may be formed to protrude from the horizontal gap preventing protrusion 35. In addition, the vertical gap preventing protrusion 34, the horizontal gap preventing protrusion 35, and the terminal holder surface 31 may be integrally formed.

Figure 6:
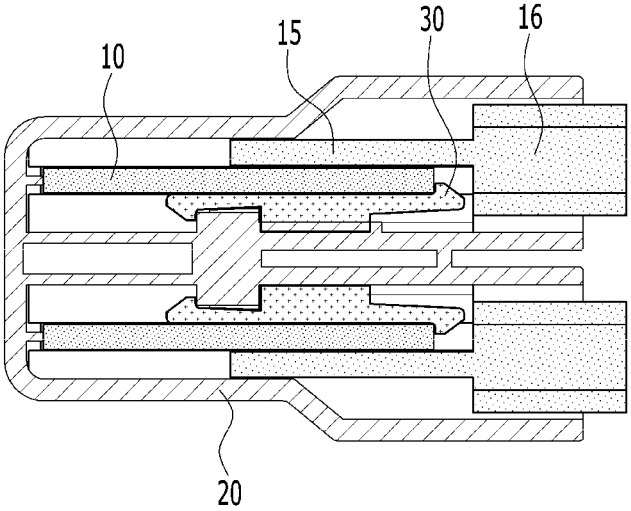
FIG. 6 is a view showing a state in which a tab terminal is fastened to an inner housing of a plug by a terminal holder according to an exemplary embodiment of the present disclosure.
Figure 7:
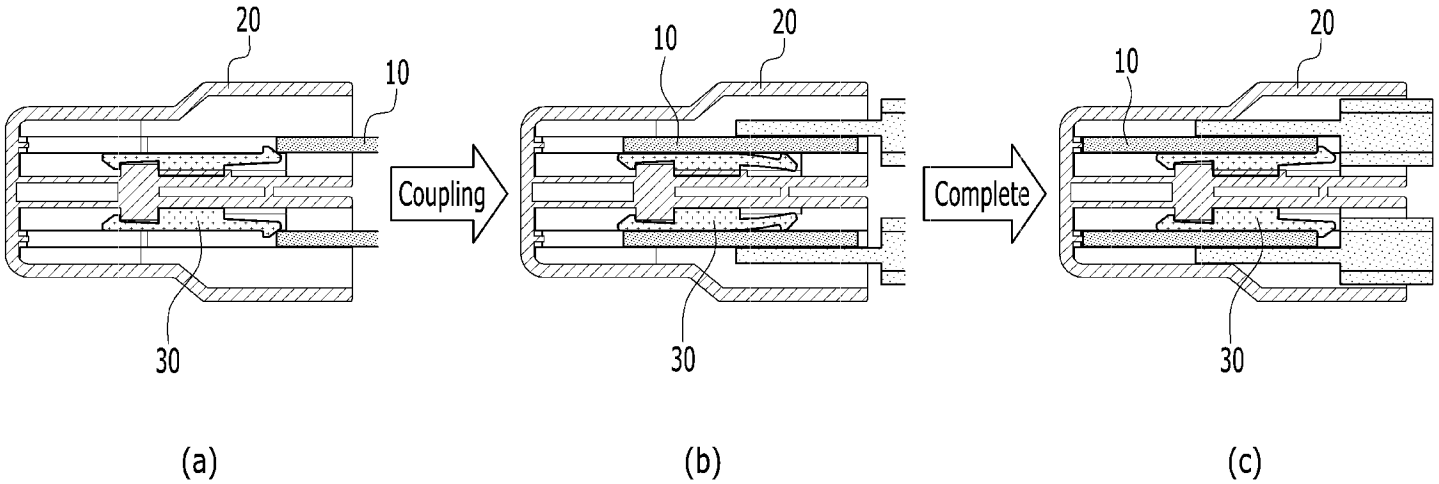
FIG. 7 is a diagram illustrating a process in which a tab terminal is fastened to a plug inner housing by a terminal holder according to an exemplary embodiment of the present disclosure.

FIG. 6 is a view showing a state in which a tab terminal is fastened to an inner housing of a plug by a terminal holder according to an exemplary embodiment of the present disclosure, and FIG. 7 is a diagram illustrating a process in which a tab terminal is fastened to a plug inner housing by a terminal holder according to an exemplary embodiment of the present disclosure.

Referring to FIG. 7, as shown in (a), the terminal holder 30 is pre-fastened to the plug inner housing 20. That is, the first hook 32 of the terminal holder 30 is fastened and fixed so as to be in close contact with the inner structure of the plug inner housing 20. In addition, the second hook 33 is spaced apart from the inner structure of the plug inner housing 20 by a predetermined distance so as to move in the inner and outer directions. When the tab terminal 10 is inserted into the plug inner housing 20, one end of the tab terminal 10 slides in while pushing the second hook 33 of the terminal holder 30. Accordingly, as shown in (b), the second hook 33 is pressed together with the terminal holder surface 31 toward the center of the plug inner housing 20 by an elastic force. After that, when the tab terminal 10 is pushed all the way to the front inner surface of the plug inner housing 20, the second hook 33 of the terminal holder 30 is restored to the outside of the plug inner housing 20 by the restoring force. In addition, as shown in (c), the cross-section of the second hook 33 is fitted to the rear end surface of the tab terminal 10. Accordingly, the tab terminal 10 is firmly fastened and fixed to the plug inner housing 20 by the terminal holder 30. Through this process, as shown in FIG. 6, a pair of tab terminals 10 connected to the electrical wire connector are fastened and fixed to the plug inner housing 20.

Figure 8:
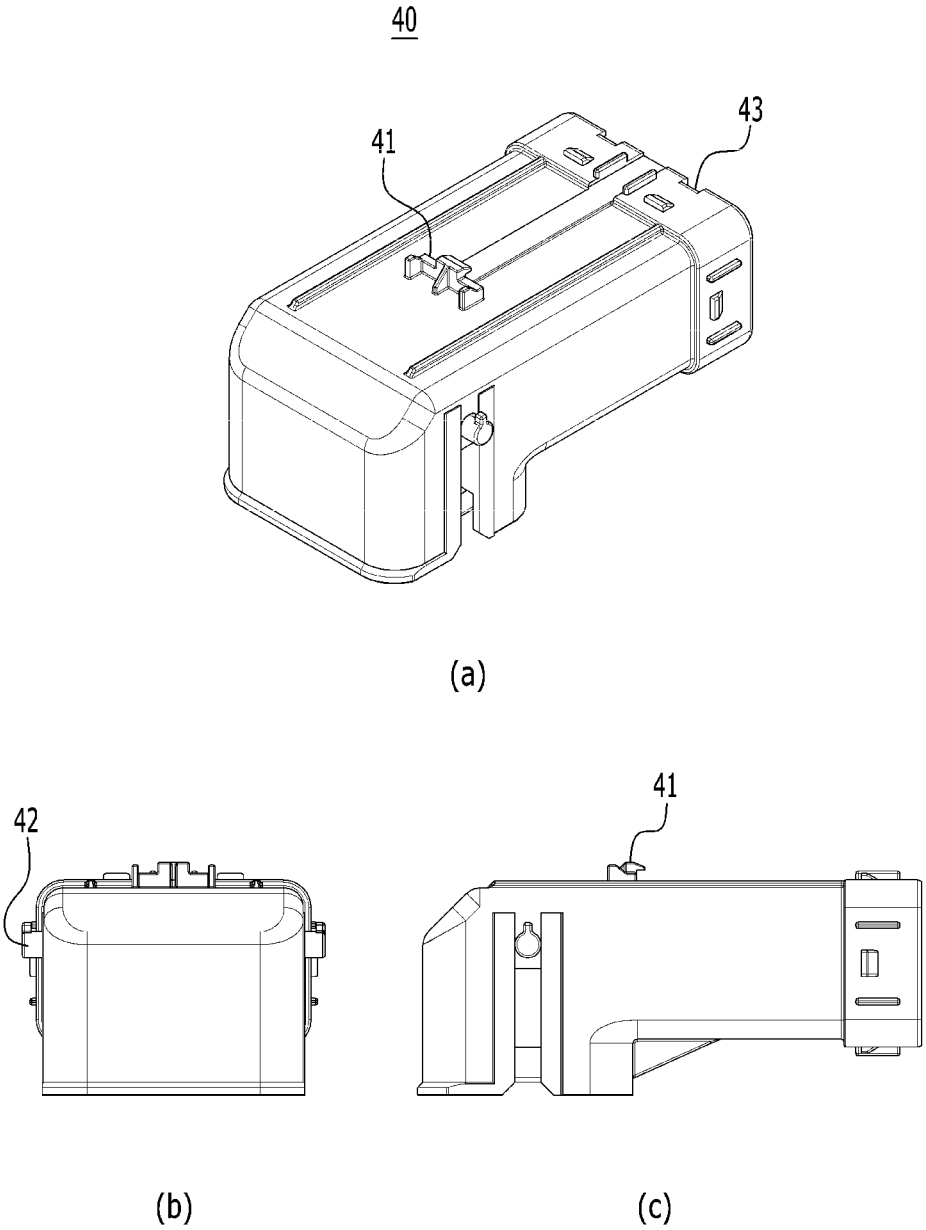
FIG. 8 is a view showing a plug outer housing according to an exemplary embodiment of the present disclosure.

FIG. 8 is a view showing a plug outer housing according to an exemplary embodiment of the present disclosure.

Referring to FIG. 8, a perspective view (a), a front view (b), and a side view (c) of the plug outer housing 40 are shown. The plug outer housing 40 has an opening at one end into which the plug inner housing 20 and the plug rear shield shell 60 are inserted. In addition, the opposite end of the opening into which the plug inner housing 20 is inserted is closed, and may be formed in an angled type with an opening formed below a second end.

The plug outer housing 40 includes a rotation protrusion 42 in the shape of a circular column protruding so that the lever 70 is rotatably coupled to the outer surface. In addition, the plug outer housing 40 is provided with a locking protrusion 41 for engaging and fixing the lever 70 after the rotation of the upper surface. In addition, at the opening-side end of one end of the plug outer housing 40, A coupling groove 43 for coupling the plug outer housing 40 and the plug rear housing by being fastened with the lance of the plug rear housing (the rightmost component of the reference numeral '80' in FIG. 2) may be provided.

In addition, a fixing groove may be formed on the front inner surface of the plug outer housing 40 in a shape corresponding to the shape of a second lance 52 so as to be coupled with the second lance 52 of the plug front shield shell 50.

Figure 9:
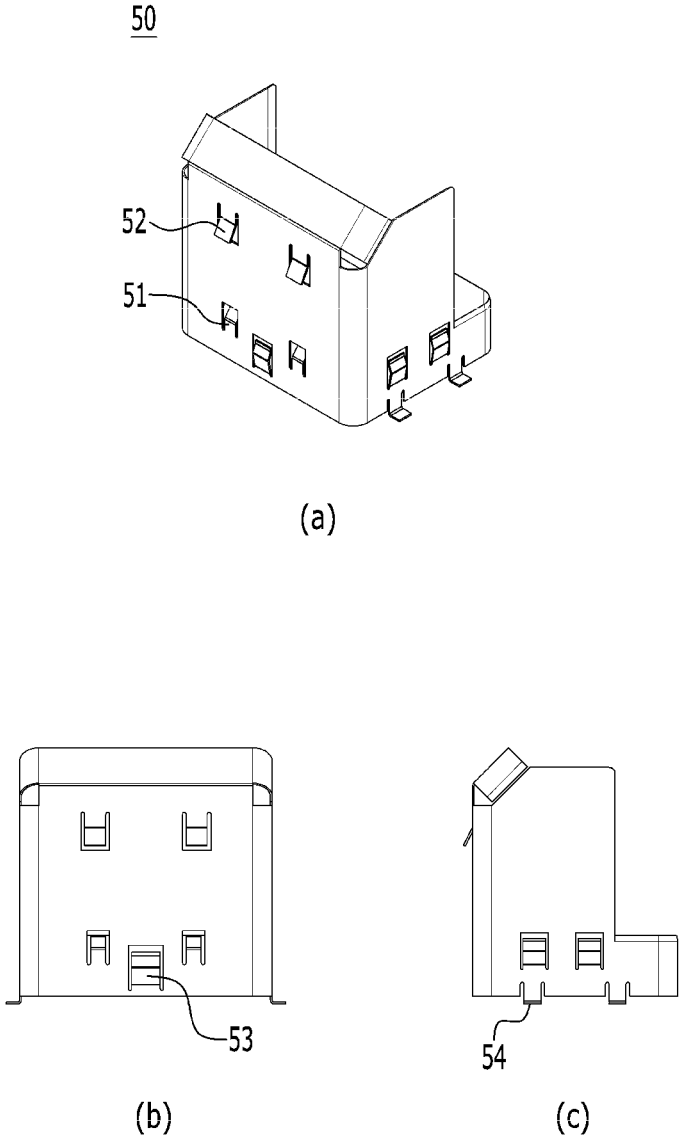
FIG. 9 is a view showing a plug front shield shell according to an exemplary embodiment of the present disclosure.
Figure 10:
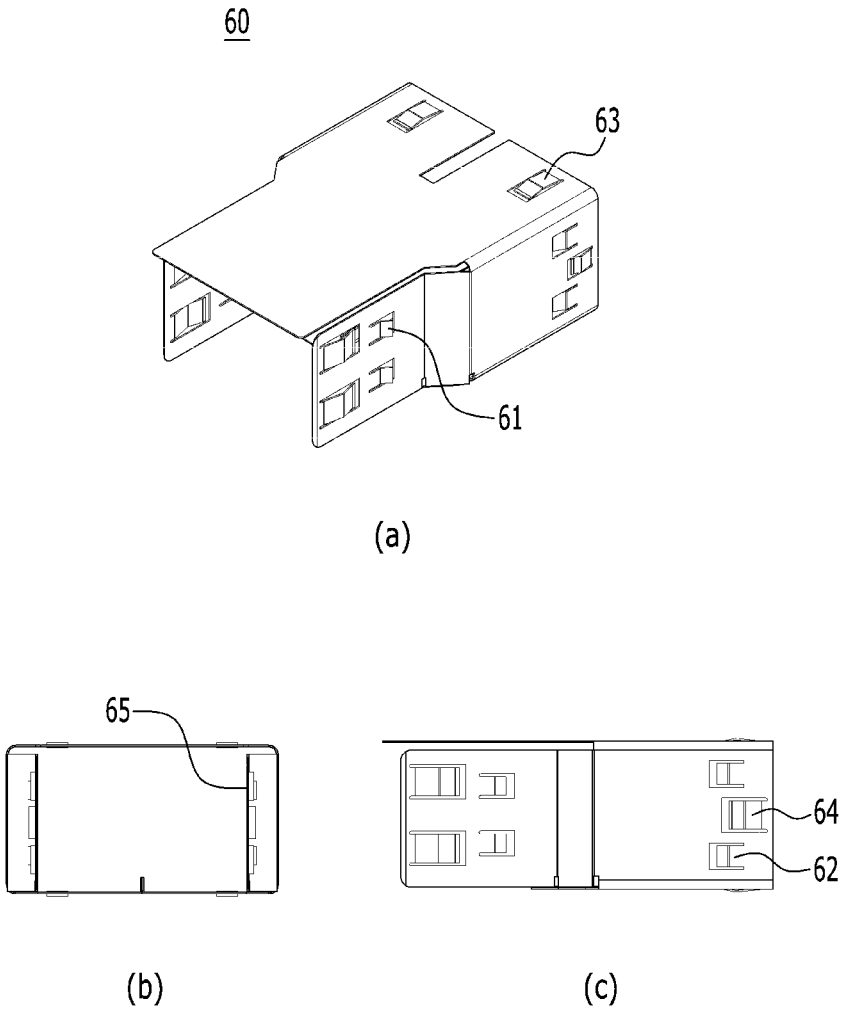
FIG. 10 is a view showing a plug rear shield shell according to an exemplary embodiment of the present disclosure.

FIG. 9 is a view showing a plug front shield shell according to an exemplary embodiment of the present disclosure, and FIG. 10 is a view showing a plug rear shield shell according to an exemplary embodiment of the present disclosure.

Referring to FIG. 9, a perspective view (a), a front view (b), and a side view (c) of the plug front shield shell 50 are shown. In addition, referring to FIG. 10, a perspective view (a), a front view (b), and a side view (c) of the plug rear shield shell 60 are shown.

As shown in FIG. 9, the plug front shield shell 50 includes a first lance 51 and a second lance 52. The first lance 51 is coupled to the outer surface of the plug inner housing 20 to prevent separation from the plug inner housing 20. The first lance 51 is coupled to a fixing groove formed on the front outer surface 23 of the plug inner housing 20 so that the plug inner housing 20 and the plug front shield shell 50 are fixed to prevent separation. In addition, the second lance 52 is coupled to a fixing groove formed on the front inner surface of the plug outer housing 40 so that the plug outer housing 40 and the plug front shield shell 50 are fixed to prevent separation.

An upper edge of the plug front shield shell 50 may be formed in a chamfer shape for guiding the fastening of the plug outer housing 40 and the plug rear shield shell 60. And, as shown in FIG. 9, the upper edge of the plug front shield shell 50 may be formed in a cut and bent shape.

Meanwhile, at the plug front shield shell 50, the inner ground portion 53 protruding to the inside of the plug front shield shell 50 to contact the plug rear shield shell 60 for grounding, and an outer grounding portion 54 protruding to the outside of the plug front shield shell 50 to ground the outside may be provided.

As shown in FIG. 10, the plug rear shield shell 60 may be formed in a shape whose width is narrowed along the direction in which the tab terminal 10 is inserted, corresponding to the shape of the plug inner housing 20.

The plug rear shield shell 60 may include an outer housing fixing protrusion 61 protruding outwardly from the side of the plug rear shield shell 60 to be fastened and fixed to an inner side of the plug outer housing 40, and an inner housing fixing protrusion 62 that protrudes inward and is fastened and fixed to the outside of the plug inner housing 20. In addition, the plug rear shield shell 60 may include contacts 63, 64 and 65 provided on the surface of the plug rear shield shell 60 and electrically connected to the plug front shield shell 50.

Similarly, according to an exemplary embodiment of the present disclosure, when assembling the connector, the terminal holder is pre-fastened to the inside of the connector housing, and when the terminal is assembled, the locking prong of the terminal and the terminal holder are fastened to each other, therefore, it is possible to strengthen the terminal holding power and improve the contact reliability of the terminal.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A terminal fastening structure of a connector, comprising:

a pair of tab terminals electrically connected to an electrical wire connector;

a plug inner housing having a first opening at a first end into which the tab terminals are inserted;

a pair of terminal holders fastened to the plug inner housing and fixing the tab terminals to the plug inner housing;

a plug outer housing having a second opening at a first end into which the plug inner housing is inserted;

a plug front shield shell inserted into a third opening formed below a second end of the plug outer housing;

a plug rear shield shell inserted into the plug outer housing with the plug inner housing inserted therein and electrically connected to the plug front shield shell; and a lever rotatably coupled to an outer surface of the plug outer housing so that the plug outer housing surrounds the plug inner housing, the plug front shield shell, and the plug rear shield shell;

wherein the plug inner housing has an angled type in which a second end facing the first opening into which the tab terminals are inserted is closed and an additional opening is formed below the second end.

2. The terminal fastening structure of the connector of claim 1, wherein:

the plug inner housing is inserted into and fixed to an inner side of the plug rear shield shell, and fixing grooves that are coupled to fixing protrusions provided on an inner surface of the plug rear shield shell are formed on upper and side surfaces of the outer plug inner housing.

3. The terminal fastening structure of the connector of claim 1, wherein the plug inner housing is formed in a shape whose width is narrowed along a direction in which the tab terminals are inserted, corresponding to a shape of the plug rear shield shell.

4. The terminal fastening structure of the connector of claim 1, wherein the tab terminals are formed in a plate shape whose width is narrowed along a direction inserted into the plug inner housing.

5. The terminal fastening structure of the connector of claim 1, wherein an edge of each of the tab terminals is formed in a chamfer shape.

6. The terminal fastening structure of the connector of claim 1, wherein the plug outer housing is formed in an angled type in which the second end facing the opening into which the plug inner housing is inserted is closed, and an additional opening is formed below the second end.

7. The terminal fastening structure of the connector of claim 6, wherein the plug outer housing has a circular columnar rotation protrusion protruding to the outer surface so that the lever is rotatably coupled.

8. The terminal fastening structure of the connector of claim 7, wherein the plug outer housing has a coupling locking protrusion on an upper surface thereof to engage and fix the lever after being rotated.

9. The terminal fastening structure of the connector of claim 1, wherein the front shield shell includes:

an inner grounding portion protruding to the inside of the front shield shell to contact the plug rear shield shell for grounding, and an outer grounding portion protruding to the outside of the plug front shield shell for grounding.

10. The terminal fastening structure of the connector of claim 1, wherein the rear shield shell includes:

an outer housing fixing protrusion protruding outwardly and fastened to an inner side of the plug outer housing, and an inner housing fixing protrusion protruding inwardly and fastened and fixed to the outside of the plug inner housing.

11. The terminal fastening structure of the connector of claim 1, wherein the plug rear shield shell includes a contact provided on a surface of the plug rear shield shell and electrically connected to the plug front shield shell.

12. A terminal fastening structure of a connector, comprising:

a pair of tab terminals electrically connected to an electrical wire connector;

a plug inner housing having an opening at a firm end into which the tab terminals are inserted; and a pair of terminal holders fastened to the plug inner housing and fixing the tab terminals to the plug inner housing;

wherein each of the terminal holders includes:

a terminal holder surface;

a first hook formed on a first side of the terminal holder surface and fastened and fixed to an inside of an inner hole; and a second hook formed on a second side facing the first side of the terminal holder surface, and pressed by elasticity when the tab terminals are inserted and fixed in the plug inner housing and then restored, and allowing the tab terminals to be fastened and released between the plug inner housing and the terminal holders.

13. The terminal fastening structure of the connector of claim 12, wherein the terminal holder surface is formed with a thickness of a surface of a side of the second hook greater than that of a surface of a side of the first hook.

14. The terminal fastening structure of the connector of claim 13, wherein a vertical gap preventing protrusion protruding in a direction perpendicular to the terminal holder surface is provided at a central portion of each of the terminal holders.

15. The terminal fastening structure of the connector of claim 14, wherein the vertical gap preventing protrusions face each other and are provided as a pair in a staggered form.

16. The terminal fastening structure of the connector of claim 15, wherein a horizontal gap preventing protrusion protruding in a direction parallel to the terminal holder surface is provided at a central portion of each of the terminal holders.

17. A terminal fastening structure of a connector, comprising:

a pair of tab terminals electrically connected to an electrical wire connector;

a plug inner housing having a first opening at a first end into which the tab terminals are inserted; and a pair of terminal holders fastened to the plug inner housing and fixing the tab terminals to the plug inner housing;

a plug outer housing having a second opening at a first end into which the plug inner housing is inserted;

a plug front shield shell inserted into a third opening formed below a second end of the plug outer housing;

a plug rear shield shell inserted into the plug outer housing with the plug inner housing inserted therein and electrically connected to the plug front shield shell; and a lever rotatably coupled to an outer surface of the plug outer housing so that the plug outer housing surrounds the plug inner housing, the plug front shield shell, and the plug rear shield shell;

wherein the plug front shield shell includes:

a first lance coupled to an outer surface of the plug inner housing to prevent separation from the plug inner housing; and a second lance coupled to an inner surface of the plug outer housing to prevent separation from the plug outer housing.

18. The terminal fastening structure of the connector of claim 17, wherein an upper edge of the plug front shield shell is formed in a bent and cut chamfer shape.

* * * * *